US005530995A

United States Patent [19]

Eichenberger et al.

[11] Patent Number: 5,530,995

[45] Date of Patent: Jul. 2, 1996

[54] COMBING MACHINE HAVING A WEB GUIDE DEVICE

[75] Inventors: Hans-Ulrich Eichenberger; Flavio Cavadini; Paul Jager, all of Winterthur, Switzerland

[73] Assignee: Rieter Machine Works, Ltd., Winterthur, Switzerland

[21] Appl. No.: 344,472

[22] Filed: Nov. 23, 1994

[30] Foreign Application Priority Data

Dec. 23, 1993 [CH] Switzerland ..... 3848/93

[51] Int. Cl.[6] ..... D01G 19/18

[52] U.S. Cl. ..... 19/231

[58] Field of Search ..... 19/115 A, 115 R, 19/216, 217, 218, 229, 230, 231, 232; 57/58, 408–413; 26/18.6, 21, 27, 18.5

[56] References Cited

U.S. PATENT DOCUMENTS

| | | | |
|---|---|---|---|
| 2,204,944 | 6/1940 | Nasmith | 19/229 |
| 2,895,177 | 7/1959 | Foster | 19/229 X |
| 2,944,302 | 7/1960 | West | 19/157 X |
| 3,577,845 | 5/1971 | Eichenberger et al. | 19/231 |
| 4,535,512 | 8/1985 | Glazener | 19/229 |
| 4,884,320 | 12/1989 | Gasser et al. | 19/106 R |

*Primary Examiner*—Ismael Izagirre
*Attorney, Agent, or Firm*—Francis C. Hand

[57] ABSTRACT

A guide plate is positioned immediately downstream of the detaching rollers of the combing head in order to deflect the web upwardly towards a deflection plate which, in turn, deflects the web back towards a trailing section of the guide plate. The guide plate and deflection plate are electrically conductive and electrically connected to the machine frame of the combing machine in order to discharge the electrostatic charges in the web. A trailing edge of the guide plate may also be inclined to deliver the web to the delivery rollers. The distance between the nip clearance of the detaching rollers and the point at which the web contacts the inclined section of the guide plate is too short to permit jamming of a web due to the rigidity of the web.

14 Claims, 1 Drawing Sheet

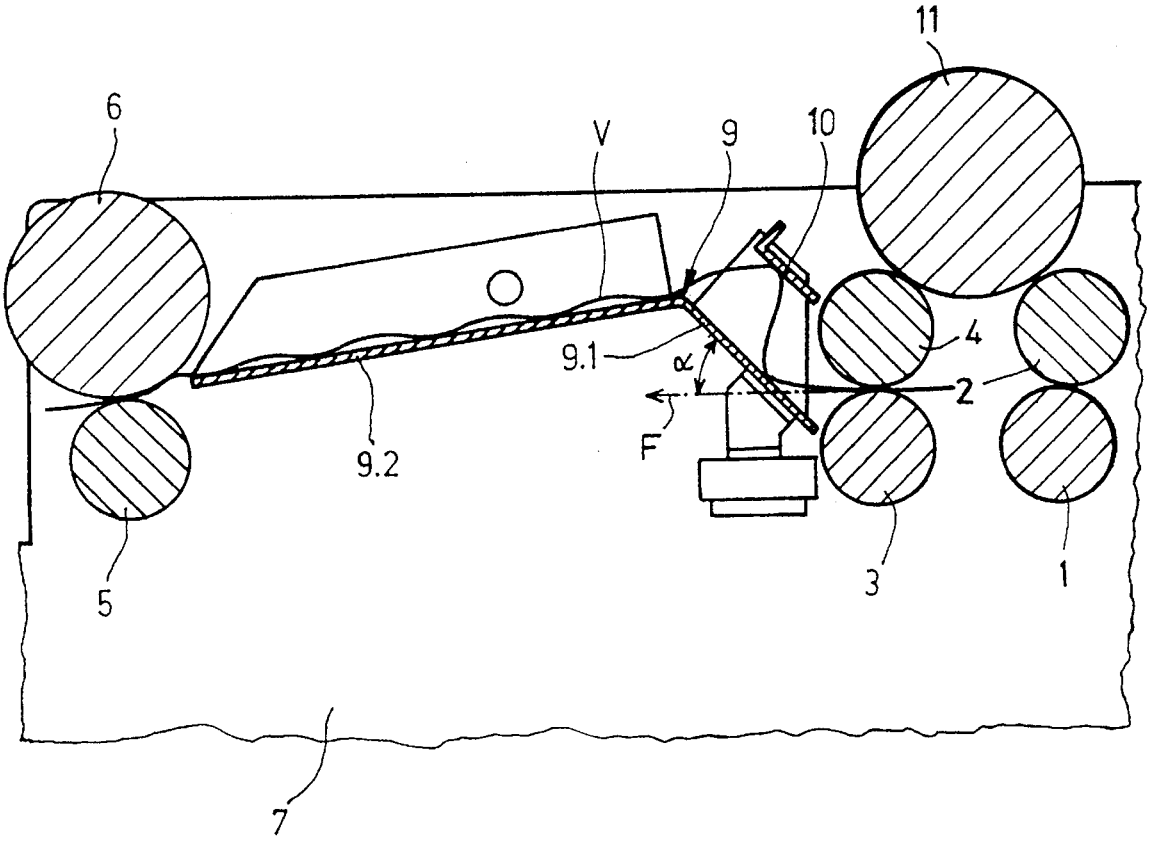
11
6
V
9
10
4
9.1
α
2
F
9.2
5
3
1
7

COMBING MACHINE HAVING A WEB GUIDE DEVICE

This invention relates to a combing machine having a web guide device. More particularly, this invention relates to a combing machine having a web guide device located between a pair of detaching rollers and a pair of delivery rollers.

As is known, the combing machines which are currently in use typically have two pairs of detaching rollers which are mounted within a machine frame and which are rotated forwards and backwards in a pilgrim motion when the combing machine is in operation. These detaching rollers receive combed tufts which are delivered in succession and form the combed tufts into a web which is then delivered downstream to a pair of delivery rollers which are also mounted within the machine frame. Typically, a web guide plate is disposed between the detaching rollers and the delivery rollers in order to guide the web. During operation, the delivery rollers rotate continuously at a constant speed. Accordingly, since the detaching rollers are rotated forwards and backwards, the web forms waves on the web guide plate.

These known combing machines are, however, subject to variable and irregular jamming of the web waves on the web guide plate downstream of the detaching rollers depending on the moisture and impurity content of the fiber material and the electrostatic charge in the web. This, in turn, can result in increased lap formation on the upper, normally rubber-covered, roller of the pair of detaching rollers adjacent to the web guide plate as well as other malfunctions.

Accordingly, it is an object of the invention to provide a web guide plate which avoids jamming of web waves on the plate downstream of a pair of detaching rollers in a combing machine.

It is another object of the invention to eliminate the electrostatic charge of a fiber web travelling between the detaching rollers and the delivery rollers of a combing machine.

It is another object of the invention to avoid increased lap formation in a web caused by waves in the web during processing through a combing machine.

Briefly, the invention is directed to a combing machine comprising a pair of detaching rollers disposed in vertical overlying relation to each other to deliver a fiber web therefrom and a pair of delivery rollers for receiving the web from the detaching rollers. In accordance with the invention, a guide plate is positioned between the detaching rollers and the delivery rollers with a first upwardly inclined surface facing the detaching rollers in order to deflect the web delivered from the detaching rollers in an upward direction. In addition, a deflection plate having a surface facing the inclined surface of the guide plate is mounted above the guide plate in order to deflect the web passing from the guide plate in a forward direction away from the detaching rollers and toward the delivery rollers.

The upwardly inclined surface of the guide plate is immediately adjacent to the pair of detaching rollers and is inclined at an angle of from 30° to 60° relative to the delivery direction of the detaching rollers (e.g. a horizontal plane) in order to deflect the web delivered from the detaching rollers in an upward direction toward the underside of the deflection plate.

In accordance with the invention, each surface of the guide plate and deflection plate is electrically conductive in order to discharge any electrostatic charge in the web extending between the two surfaces.

The guide plate also has a second surface which extends from the first surface toward the delivery rollers in order to receive and guide the web from the deflection plate to the delivery rollers. This second surface of the guide plate may also be inclined at an angle not exceeding plus or minus 15° relative to a horizontal plane. In addition, this second surface is of a length at least equal to the length of the first surface of the guide plate relative to the web.

These and other objects and advantages of the invention will become more apparent from the following detailed description taken in conjunction with the accompanying drawing wherein:

The drawing illustrates a schematic vertical section through a combing head of a combing machine constructed in accordance with the invention.

Referring to the drawing, the combing machine has a combing head which is comprised of two pairs of detaching rollers 1, 2 and 3, 4 as well a pair of delivery rollers 5, 6. The detaching rollers 1, 2, 3, 4, and the delivery rollers 5, 6 are mounted so as to be rotated about respective horizontal axes within a machine frame 7 of the combing machine. As illustrated, the rollers 3, 4 of the downstream pair of detaching rollers are disposed in vertical overlying relation to each other in order to deliver a fiber web V therefrom in a substantially horizontal direction F.

As illustrated, a guide device is mounted within the machine frame 7 between the downstream pair of detaching rollers 3, 4 and the pair of delivery rollers 5, 6. This web guide device includes a guide plate 9 for receiving and guiding the web V delivered from the pair of detaching rollers 3, 4 to the pair of delivery rollers 5, 6.

The guide plate 9 has a first leading section 9.1 immediately adjacent to the downstream pair of detaching rollers 3, 4 with an upper inclined surface facing the detaching rollers 3, 4 in order to deflect the web V delivered therefrom in an upward direction. That is to say, the guide plate section 9.1 inclines upwardly relative to the delivery direction F, for example at an angle $\alpha$. In this regard, the delivery direction F is in a direction transverse, i.e. perpendicular to a plane which includes the axes of both detaching rollers 3, 4. The angle $\alpha$ is generally between 30° and 60° and is preferably 45° relative to a horizontal plane coincident with the delivery direction F. It is to be noted that the term "immediately adjacent" means that the point at which the web V meets the upper side of the guide plate section 9.1 should be a minimal distance from the nip clearance of the detaching rollers 3, 4. This distance can be approximately the same order of magnitude as the diameter of the detaching rollers 3, 4, i.e. about 2 to 3 centimeters. Over such a short distance, the rigidity of the web V is sufficient to prevent the web from adhering to the contact point on the guide plate 9 and becoming jammed between the nip clearance of the detaching rollers 3, 4 and the contact point.

The web guide device also includes a deflection plate 10 which is located at a distance above the leading section 9.1 of the guide plate 9. As indicated, the deflection plate 10 has a surface facing the inclined surface of the guide plate section 9.1 in order to deflect the web V passing from the leading guide plate section 9.1 in the forward direction away from the detaching rollers 3, 4, and towards the pair of deliver rollers 5, 6. In this respect, the underside of the deflection plate 10 extends approximately parallel to the upper surface of the leading guide plate section 9.1. In any case, the channel enclosed between the deflection plate 10 and the inclined surface of the guide plate 9 should not narrow significantly towards the top so as to avoid the risk of jamming of the web. The deflection plate 10 also serves to prevent movements of the web V into the area of the upper detaching roller 4 and a cleaning roller 11 which bears on the upper detaching rollers 2 and 4. This eliminates a further risk of lap formation.

The deflection plate 10 may be supported on the leading section 9.1 of the guide plate 9 but may also be mounted within the machine frame 7 independently of the guide plate 9.

The guide plate 9 and the deflection plate 10 are generally composed of sheet metal and are electrically conductive. In addition, the plates 9, 10 are electrically connected to the machine frame 7. In each case, however, at least the upwardly inclined surface of the guide plate 9 and the underside surface of the deflection plate 10 must be electrically conductive and electrically connected to the machine frame 7.

As is known, the web V delivered from the pair of detaching rollers 3, 4 always contain a substantial electrostatic charge. This charge may occur primarily on the upper side of the web V which was previously in contact with rubber coatings on the upper detaching rollers 2 and 4. During travel through the web guide device, the underside of the web V delivered from the pair of detaching rollers 3, 4 first contacts the electrically conductive upper side of the section 9.1 of the guide plate 9. Thereafter, the upper side of the web V then contacts the electrically conductive underside of the deflection plate 10. Hence, virtually all the electrostatic charge on the web is diverted to the machine frame 7.

As illustrated, the web V deflected unto the deflection plate 10 passes back onto a second section 9.2 of the guide plate 9 and is guided towards the delivery rollers 5, 6. As illustrated, this second section 9.2 of the guide plate 9 provides a surface which extends from the inclined surface of the leading section 9.1 towards the delivery rollers 5, 6.

Since the electrostatic charge on the web V has been diverted, there are no problems due to electrostatic attraction of the web V on the section 9.2 of the guide plate 9.

The inclination of the trailing section 9.2 of the guide plate 9 relative to the delivery direction F of the detaching rollers 3, 4 is not critical. In expedient embodiments, this second section 9.2 has a lesser angle of: inclination from a horizontal plane than that of the leading section 9.1 adjacent to the detaching rollers 3, 4. For example, the trailing section 9.2 may be inclined at an angle of between minus 15° and plus 15° to the delivery direction F, i.e. relative to a horizontal plane. In addition, the length of the trailing section 9.2 is at least equal to the length of the steeper leading section 9.1 of the web plate 9.

The invention thus provides a web guide device which is able to guide a web delivered from a pair of detaching rollers in a manner to avoid jamming while also removing any electrostatic charge in the web.

The invention further prevents jamming of the web delivered from the detaching rollers by maintaining the distance between the nip clearance of the detaching rollers and the point at which the web meets the inclined leading section of the guide plate at a short distance relative to the rigidity of the web.

The invention further eliminates electrostatic attraction between a moving web and a guide plate leading to the delivery rollers of a combing head of a combing machine.

What is claimed is:

1. A combing machine comprising a pair of detaching rollers disposed in vertical overlying relation to each other to deliver a fiber web therefrom;

a guide plate having a first upwardly inclined surface facing said detaching rollers to deflect a web delivered therefrom in an upward direction;

a deflection plate having a surface facing said inclined surface of said guide plate to deflect a web passing from said guide plate in a forward direction away from said detaching rollers; and a pair of delivery rollers for receiving the web deflected from said deflection plate.

2. A combing machine as set forth in claim 1 wherein each said surface of said guide plate and said deflection plate is electrically conductive to discharge a web extending therebetween of electrostatic charges.

3. A combing machine as set forth in claim 1 wherein said surfaces of said plate are in parallel to each other.

4. A combing machine as set forth in claim 1 wherein said surface of said guide plate is inclined at an angle of from 30° to 60° relative to a horizontal plane.

5. A combing machine as set forth in claim 4 wherein said surface of said guide plate is inclined at an angle of 45° relative to a horizontal plane.

6. A combing machine as set forth in claim 1 wherein said guide plate has a second surface extending from said first surface towards said delivery rollers to receive and guide the web from said deflection plate to said delivery rollers.

7. A combing machine as set forth in claim 6 wherein said second surface of said guide plate is inclined at an angle not exceeding ±15° relative to a horizontal plane.

8. A combing machine as set forth in claim 6 wherein said second surface of said guide plate is of a length relative to said web at least equal to the length of said first surface of said guide plate.

9. In a combing machine the combination comprising a pair of detaching rollers disposed in vertical overlying relation to each other to define a nip for delivering a fiber web therefrom;

a web guide device including a guide plate having a first upwardly inclined surface facing said detaching rollers to deflect a web delivered therefrom in an upward direction and a second surface for guiding the web thereon, said plate being spaced horizontally from said nip a distance of about 2 to 3 centimeters; and a pair of delivery rollers for receiving the web from said second surface of said plate.

10. The combination as set forth in claim 9 wherein said first surface of said guide plate is inclined at an angle of from 30° to 60° relative to a horizontal plate.

11. The combination as set forth in claim 10 wherein said second surface of said guide plate is inclined at an angle not exceeding ±15° relative to a horizontal plane.

12. The combination as set forth in claim 9 wherein said second surface of said guide plate is of a length relative to said web at least equal to the length of said first surface of said guide plate.

13. In a combing machine the combination comprising a pair of detaching rollers disposed in vertical overlying relation to each other to deliver a fiber web therefrom, a guide plate having a first upwardly inclined surface facing said detaching rollers to deflect a web delivered therefrom in an upward direction, a deflection plate having a surface facing said inclined surface of said guide plate to deflect a web passing from said guide plate in a forward direction away from said detaching rollers.

14. A combing machine as set forth in claim 13 wherein each said surface of said guide plate and said deflection plate is electrically conductive to discharge a web extending therebetween of electrostatic charges.

* * * * *

UNITED STATES PATENT AND TRADEMARK OFFICE

CERTIFICATE OF CORRECTION

PATENT NO. : 5,530,995

DATED : July 2, 1996

INVENTOR(S) : Hans-Ulrich Eichenberger, et al

It is certified that error appears in the above-indentified patent and that said Letters Patent is hereby corrected as shown below:

Column 3, line 40 cancel ":"
Column 4, last line add the following claims:

15. A combing machine as set forth in claim 13 further comprising a machine frame having said rollers mounted therein and wherein each of said guide plate and said deflection plate is electrically connected to said machine frame.

16. A combing machine as set forth in claim 1 further comprising a machine frame having said rollers mounted therein and wherein each of said guide plate and said deflection plate is electrically connected to said machine frame.

Signed and Sealed this

Twenty-fourth Day of December, 1996

*Attest:*

Bruce Lehman

BRUCE LEHMAN

*Attesting Officer*

*Commissioner of Patents and Trademarks*